US005992935A

United States Patent [19]

Duijnstee

[11] Patent Number: 5,992,935

[45] Date of Patent: Nov. 30, 1999

[54] SWIVEL CHAIR AND STAIR LIFT PROVIDED WITH SUCH A SWIVEL CHAIR

[75] Inventor: Eduard Josef Maria Duijnstee, Ouderkerk aan den Ijssel, Netherlands

[73] Assignee: Thyssen De Reus B.V., Ln Krimpenaan den Ijssel, Netherlands

[21] Appl. No.: 09/068,294

[22] PCT Filed: Nov. 8, 1996

[86] PCT No.: PCT/NL96/00438

§ 371 Date: Jul. 24, 1998

§ 102(e) Date: Jul. 24, 1998

[87] PCT Pub. No.: WO97/19886

PCT Pub. Date: Jun. 5, 1997

[30] Foreign Application Priority Data

Nov. 10, 1995 [NL] Netherlands ..... 1001635

[51] Int. Cl.[6] ..... A47C 3/18

[52] U.S. Cl. ..... 297/344.21; 297/344.22

[58] Field of Search ..... 297/344.21, 344.22, 297/344.26, 256.12; 248/415, 425

[56] References Cited

U.S. PATENT DOCUMENTS

| | | | |
|---|---|---|---|
| 374,250 | 12/1887 | Hayward | 297/344.22 X |
| 775,879 | 11/1904 | Wiersching et al. | 297/344.22 |
| 3,142,471 | 7/1964 | Silver | 297/344.21 X |
| 4,544,202 | 10/1985 | Keaton | 297/344.22 |
| 4,815,785 | 3/1989 | Goodall et al. . | |
| 5,230,405 | 7/1993 | Bartelt . | |

FOREIGN PATENT DOCUMENTS

| | | | |
|---|---|---|---|
| 356071637 | 6/1981 | Japan | 297/344.21 |

*Primary Examiner*—Peter R. Brown
*Attorney, Agent, or Firm*—Merchant & Gould P.C.

[57] ABSTRACT

A swivel chair (1), comprising a seating part (2, 3) or a like support means and a support part, wherein the seating part is pivotally connected, via a first axis of rotation (4) which, during use, extends substantially vertically, to the support part (5), wherein mechanical activating means are provided for swiveling the seating part around the first axis of rotation, which activating means, during use, contact at least temporarily the seating part of the one hand and the swivel part on the other, the arrangement being such that through operation of the activating means, an activating force is exerted relative to the support part for initiation of a swivel movement of the seating part, and a stair lift comprising such a swivel chair.

12 Claims, 3 Drawing Sheets

SWIVEL CHAIR AND STAIR LIFT PROVIDED WITH SUCH A SWIVEL CHAIR

FIELD OF THE INVENTION

The invention relates to a swivel chair, in particular suitable for use with stair lift or the like. Such a swivel chair is known from U.S. Pat. No. 4,544,202.

BACKGROUND OF THE INVENTION

From practice a swivel chair is known comprising a seating part mounted in a leg by means of a shaft so that the seating part can freely rotate about the shaft. As a result, it is possible to change the position of the seating part relative to the leg. For that purpose, a user of the chair should take off with his or her feet against the floor or another object connected to the fixed world, and, having reached the desired position, stop himself with his feet. In fact, for taking off and/or braking, it is also possible to use one's hands, provided that a grip suitable therefor be present. Such a swivel chair has a simple construction and may be easy to operate. However, this known swivel chair has as a drawback that a stationary point should always be present for taking off. If the feet are used therefor, they should be placed on the floor and hence, during the rotation, they cannot remain positioned on, for instance, a foot rest rotating along. Further, a floor or the like should be present, which is not always the case, for instance when the swivel chair is used with a stair lift. Moreover, the user should have the disposal of at least one foot which, moreover, should be able to produce the necessary power, which will often not or at least not always be the case with, in particular, semi-invalid and elderly users. Comparable drawbacks apply to the use of one's hands for taking off and/or braking.

Further, from practice, swivel chairs are known whose rotation can be initiated and/or braked through electric or like, not strictly mechanical energization. Such a swivel chair is complicated and costly in manufacturing, use and maintenance and is moreover relatively voluminous.

A swivel chair known from U.S. Pat. No. 4,544,202 comprises a seating part and a support part. The seating part is pivotly connected to the support part via a first axis of rotation which, during use extends substantially vertically. Mechanical activating means are provided for swivelling the seating part around the first axis of rotation. During use the activating means contact the seating part and the support part whereby operation of the activating means causes exertion of an activating force relative to the support part for initiating of a swivel movement of the seating part.

In this known swivel chair the support part is provided with a bowl shaped base with a series of regularly spaced holes around its edge, concentric relative to the central axis of rotation of the seating part. Under the seating part a gear wheel is provided, the teeth of which can cooperate with said holes in the base, which gear wheel can be rotated by means of a handle extending at the side of the seating part. By rotation of the gear wheel thus the seating part will be rotated around said axis of rotation, to a desired position. In this known swivel chair the movement of the seating part is continuously guided and controlled by the said handle, whereby the seating part can be rotated over 360° or more.

This known swivel chair has the disadvantage that the full movement of the seating part has to be provided for and continuously controlled by the person sitting on the seating part. Furthermore, no specific end positions are provided in such a known swivel chair.

SUMMARY OF THE INVENTION

The object of the invention is to provide a swivel chair wherein the drawbacks of the known swivel chairs are avoided, while the advantages thereof are retained. To that end, a swivel chair according to the invention is characterized by activating means being operable in at least two extreme positions of the seating part relative to the support part, for initiating a swivel movement of the seating part. During movement of the seating part relative to the support part, the activating means pass a dead-center position to one of the extreme positions, and said passing is at least substantially caused under the influence of the mass inertia of the seating part and a user who may be present thereon.

The mechanical activating means provide the possibility of providing, through the operation thereof, a take-off force for at least starting a swivel movement of the seating part. Because this involves the seating part taking off in a mechanical manner and in rotational sense against the support part, it is no longer necessary for the user to take off against any object in his or her environment. The mechanical activating means can have a simple construction and require no energization other than the operating energy to be produced by the user, which can be relatively low.

Since the movement between the starting and end position of movement of the seating part is provided for by mainly the inertia of the seating part and possibly a person sitting thereon, only the starting impulse is necessary, not a full control during said movement. Especially for elderly and disabled persons or persons having little force control this is advantageous.

In a first advantageous embodiment, a swivel chair according to the invention is characterized by activating means comprising at least a swivel arm and a connecting rod, wherein the swivel arm is rotatable about a second axis of rotation and is connected to the seating part. When the seating part is swiveled, said swivel arm swivels together therewith around the first axis of rotation. The connecting rod is connected, adjacent a first end thereof, to the support part and adjacent an opposite second end thereof to the swivel arm, at a distance from the second axis of rotation. Through swivel movement of the swivel arm, the second end of the connecting rod is movable relative to the first end, so that the perpendicular distance between the second axis of rotation and the first end changes thereby.

In this embodiment, the swivel arm rotates together with the seating part about the first axis of rotation. Because the first end of the connecting rod is connected to the support part and the second end is connected to the swivel arm at a distance from the second axis of rotation, the distance between the first end of the connecting rod and the second axis of rotation will vary when the seating part is rotated about the first axis of rotation. Through displacement of the second end relative to the fastening point of the first end, the length of the projection of the connecting rod on the imaginary connecting line between the second axis of rotation and the first end and extending along a normal of the second axis of rotation, is changed. If the second end of this imaginary connecting line is deflected, the length of the projection is reduced and the second axis of rotation is drawn closer to the first end. However, this is only possible if the seating part with the swivel arm rotates about the first axis of rotation. Similarly, an opposite rotation of the seating part can be effected, viz. by moving the second end closer to the imaginary connecting line.

Hence, with a swivel chair according to this embodiment, a rotation of the seating part relative to the support part is enabled in a particularly simple manner, without utilizing complicated energizations and energy supplies, and without necessitating taking off against an object in the environment.

In a first further elaboration, a swivel chair according to the invention is characterized the fastening point for the first end of the connecting rod being located at a distance from the first axis of rotation.

Because the fastening point for the first end of the connecting rod is spaced from the first axis of rotation, the starting of the movement of the seating part of the swivel chair will always involve the desired direction being chosen, because the line of forces through the connecting rod crosses but does not intersect the first axis of rotation. This means that in each case, the desired direction of rotation is obtained without this requiring separate means.

In a second further elaboration, a swivel chair according to the invention is characterized in that, by the second axis of rotation and the first end of the connecting rod, a central plane is defined, wherein the connecting rod can, through swivel movement of the swivel arm, be brought into a first position wherein the first and the second end thereof are located in the central plane and the distance between the first end and the second axis of rotation is almost maximal, and into a second position wherein the second end of the connecting rod has moved out of the central plane and the distance between the first end and the second axis of rotation is smaller When, in the first position, the first and the second end of the connecting rod are both located in the central plane, the maximum distance between the second axis of rotation and the first end is set. When from this position, a rotation is made in one of the two directions, this distance will only decrease, at least in the first instance. Thus, in the first position of the connecting rod, an end stop is obtained wherein the rotation of the seating part is substantially blocked. Only when the connecting rod is actively moved out of this position by means of the activating means or by utilizing the mass inertia of the moving parts and/or gravity, can this so-called dead center be passed. By providing a stop on one of the sides of the connecting rod or swivel arm in such a manner that it can move at least almost not any further than the first position, an end position of the seating part is determined which can also provide a locking.

In a further advantageous embodiment, a swivel chair according to the invention is characterized by the second axis of rotation extending almost horizontally during use.

In this embodiment, the swivel arm extends approximately horizontally, for instance directly under the seating face of the seating part, so that, for the operation thereof, a movement in an approximately vertical plane is necessary. For a user in the chair, this is usually a simple direction of operation. Moreover, during the operation, gravity can suitably be used, for instance for fixing the seating part in the locked position in the above-mentioned manner. As a matter of fact, the second axis of rotation can also extend for instance approximately vertically. In such embodiment, a movement of the swivel arm in a substantially horizontal plane is particularly suitable. Such a movement is for instance particularly suitable for users who can produce little or no power with their hands and/or forearms. In fact, a swivel arm can of course also be suitable for operation by other limbs or in other directions. The operating forces can be chosen to be particularly low by using suitable lengths of the different parts that act as levers.

In further elaboration, a swivel chair according to the invention is characterized in that the connecting rod comprises means for setting the length thereof.

Adjustability of the length of the connecting rod offers the advantage that the angle which is included between two extreme positions and which can be travelled by the seating part through swivel movement, is settable. After all, at a greater length, a greater angle is included.

In an alternative embodiment, a swivel chair according to the invention is characterized in that the activating means comprises at least a swivel arm, rotatable about a second axis of rotation and comprises an eccentric cam part. A run-on path is provided on the support part, and said run-on path extends along at least a part of a circular path around the first axis of rotation. The cam part abuts, in at least two positions of the seating part, in a recess, against the run-on path, so that through rotation of the cam part, the cam part is moved against and subsequently along the run-on path while the seating part is being swiveled In this embodiment, rotation of the swivel arm causes the seating part to initiating said movement, via one of the cam parts and in direction of rotation, against the fixed part of the run-on path. The cam part then passes a portion of the run-on path so far until the swivel arm can return into the starting position because the or each cam part can be received in a next opening in the run-on path. In that position, the seating part can then be caused to take off again by means of an eccentric cam part, preferably a cam part adjacent an opposite side of the seating part and in a direction opposite to the first-mentioned direction of movement. However, it is also possible to construct the swivel arm so as to be movable in two directions, for instance, with the eccentric cam part acting on both sides. In such a manner, the seating part can be moved back and forth between two extreme positions by taking off a simple manner with an eccentric cam part, while there is no fixed connection between the support part and the seating part.

In a particularly advantageous embodiment, a swivel chair according to the invention is characterized in that the seating part comprises a foot rest which is connected thereto and can swivel along with the seating part.

The foot rest rotating along with the seating part offers the advantage that a user of such a swivel chair always retains a proper support of the feet, also if the chair is in such a position that a floor is located at a relatively great distance, for instance above a stair. This considerably improves the user's comfort and safety during use. In particular for semi-invalid users who have for instance lost the use of their legs and/or feet entirely or partly, such a swivel chair is particularly suitable, especially for stair lifts and like displacement apparatuses.

Further advantageous elaborations of a swivel chair according to the invention are given in the further subclaims and the specification.

The invention further relates to a stair lift comprising a swivel chair according to the invention. Such a stair lift has important economical, technical and ergonomic advantages over stair lifts comprising a known swivel chair.

BRIEF DESCRIPTION OF THE DRAWINGS

To explain the invention, exemplary embodiments of a swivel chair and chair lift will hereinafter be described, with reference to the accompanying drawings. In these drawings.

DETAILED DESCRIPTION OF PREFERRED EMBODIMENTS

Figure 1:
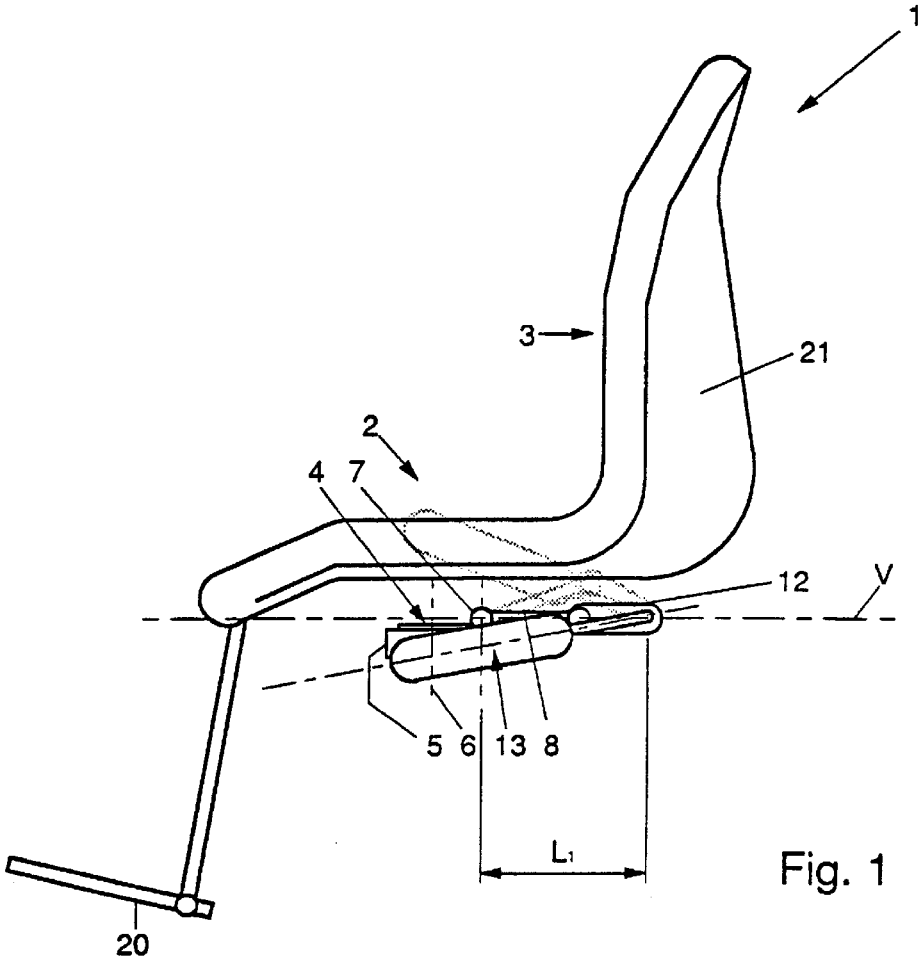
FIG. 1 is a side elevation of a swivel chair according to the invention.

FIG. 1 shows, in side elevation, a swivel chair, indicated by reference numeral 1. Such a swivel chair is or instance used with a stair lift, in particular if there is insufficient space adjacent an upper or lower end of the stair lift rail for allowing the chair to move on sufficiently far to allow a user thereof to reach a standing position on an building floor to be entered upon or, if necessary, change into a wheelchair or the like. The point is that conventionally, a chair of a stair lift is so arranged that during an upward or downward movement, the user is seated with the medial plane approximately transverse to the direction of movement. If in such case the stair lift rail ends directly above the end of the stair, the chair should be rotated through an angle of, for instance, about 90° in the direction away from the stair, enabling the user to get off or sit down on the chair in a simple manner. In fact, in other situations too, it is often advantageous if a chair can swivel.

The swivel chair 1 comprises a seating part 2 and a back support part 3, in the embodiment shown of a one-piece and bucket-shaped construction. Hereinafter, the seating part 2 and the back support part 3 will be referred to as bucket 21. By means of a shaft 4, the bucket 21 is connected to a support part 5 which is fixedly mounted on a rail engagement part or a different type of base, not shown. The shaft 4 is bearing-mounted in the support part 5 or in the bucket 21 so as to enable the bucket 21 to swivel, relative to the support part 5, about a first axis of rotation 6 which, during use, extends substantially vertically. The support part 5 is flange-shaped and comprises at least a first fastening point 13 for a first end 7 of a connecting rod 8.

Under the bucket 21, an operating arm 9 is bearing-mounted so that the operating arm 9 can be swivelled about a second axis of rotation 10 which, during use, extends approximately horizontally. The operating arm 9 is on either side of the bucket 21 provided with a handle 11 which includes an angle with the part of the operating arm 9 enclosed between the handles 11. In a central part, the operating arm 9 comprises a pin 12, fixedly connected thereto and extending approximately at right angles to the second axis of rotation 10, in a general sense approximately in the direction of the first axis of rotation 6. At a distance from the second axis of rotation 10, the pin 12 comprises a fastening point 14 for the second end 15 of the connecting rod 8. Consequently, through swivel movement of the operating arm 9, the second fastening point 14 is moved up and down.

Between the first 13 and the second fastening point 14, the connecting rod 8 is provided, at either end thereof fastened by means of a universal coupling 16 or a like connection. The universal couplings 16 provide that during movement of the connecting rod 8, the angles included thereby with the pin 12 on the one hand and with the support part 4 on the other can vary. In the embodiment shown, the connecting rod consists of two end part 17 provided, at the facing ends, with a recess having internal screw thread, the end parts 17 being connected by a coupling pin 18 having external screw thread and screwed into the recesses. Provided on the coupling pin are two nuts 19, by means of which the end parts 17 on the coupling pin 18 can be fixed in position. Through rotation of the end parts 17 relative to each other and the coupling pin 18, the length of the connecting rod 8 can be changed, after which the position can be fixed again by means of the nuts 19. The purpose hereof will be further explained hereinbelow.

The freedom of movement of the operating arm 9 is limited at least in downward direction so that the pin 12 cannot swivel downwards further than a position slightly beyond a horizontal position.

At the front side of the chair, a foot rest 20 is connected to the bucket 21, so that when the bucket 21 is rotated, the foot rest 20 also swivels about the first axis of rotation 6.

A swivel chair in an embodiment shown in FIGS. 1–3 can be used as follows.

A user sits down in the bucket 21 of the chair and grips, with one or two hands, the operating rod 9 at the handles 11 in the lowest position. This means that the swivel chair is in a first extreme position (FIG. 2). Next, the user pulls the handles 11 upwards, causing the bucket 21 together with the foot rest 20 to rotate about the first axis of rotation 6. This involves the operating arm 9 rotating along. After the movement has been started, the user releases the operating arm 9, causing the handles 11 to fall back into the first position and the bucket 21 to come to a standstill, in the second extreme position (FIG. 3).

The movement of the bucket 21 resulting from the swivel movement of the operating arm 9 can be understood as follows.

In the first and the second position of the bucket 2 (FIGS. 2 and 3), the pin 12 is approximately horizontal. In side elevation, the pin 12 and the connecting rod 8 are now approximately in line. In this position, the length $L_1$ of the projection of the pin 12 and the connecting rod 8 in a plane V, determined by the second axis of rotation 10 and the first fastening point 13, is maximal. When the handles are moved upwards, the second fastening point 14 moves upwards. Consequently, the length of the projection of the pin 12 and the connecting rod 8 in the plane V becomes shorter. This is only possible through rotation of the bucket 2 into the position shown in FIG. 4, with at least the first 13 and the second fastening point 14 and the first axis of rotation being approximately in or at least parallel to one vertical plane P. In that position, the distance $L_2$ between the second axis of rotation 10 and the first fastening point 13 is minimal. This position is a so-called "dead center" position, which means that if the bucket stands still in this position, it cannot in fact be set in motion by means of the operating arm 9. As a result of the movement of the bucket 12 that exists when the bucket moves from an extreme position (FIGS. 2 and 3) to the central position (FIG. 4) and the mass inertia of the bucket and, possibly, the person seated thereon, the bucket 2 is guided along this central position (FIG. 4). Further drive of the bucket 2 is not necessary therefor.

Figure 3:
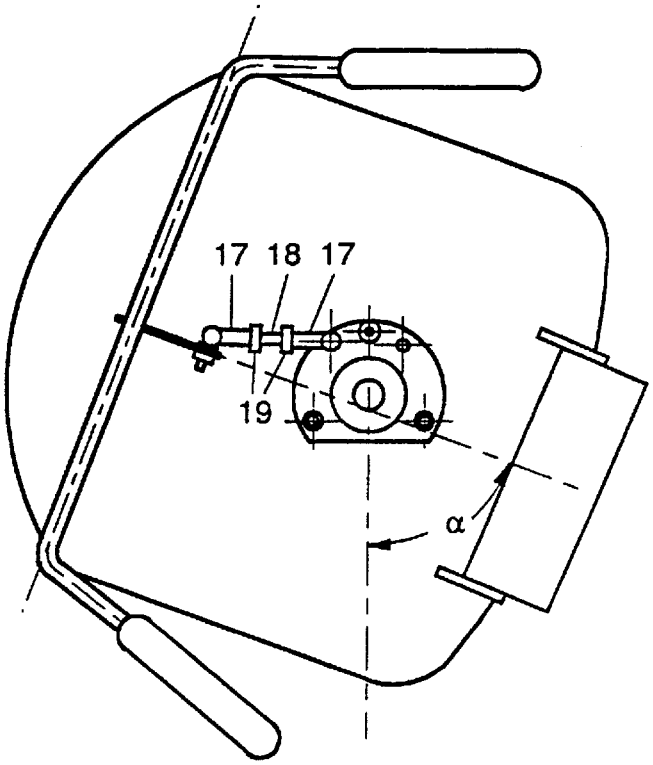
FIG. 3 is a bottom view of a swivel chair in FIG. 1, in a second position.
Figure 4:
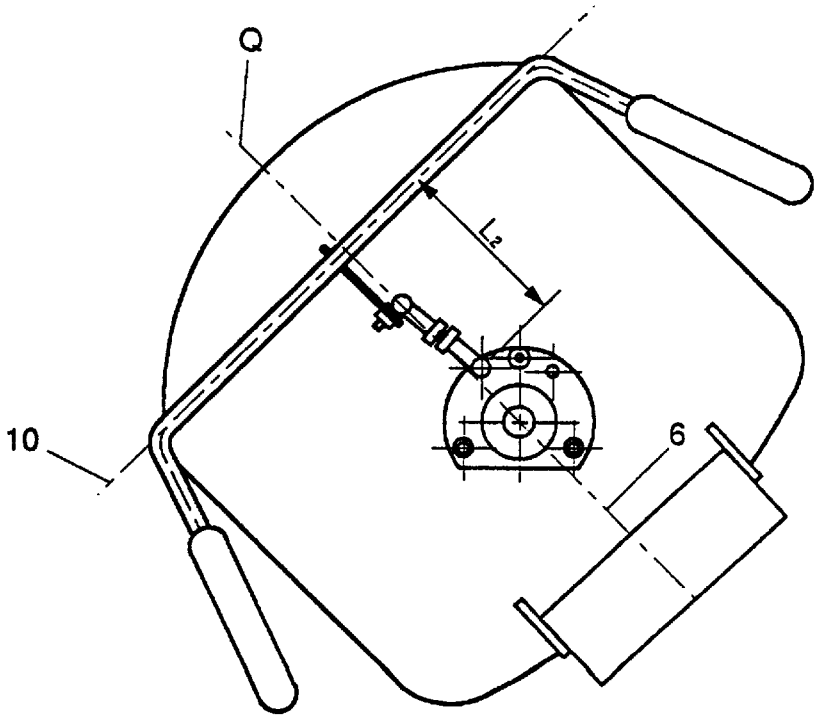
FIG. 4 is a bottom view of a swivel chair in FIG. 1, in a position between the first and the second position.

After the bucket has passed the "dead center" central position, the handles 11 and the pin 12 lower back into the starting position so that the bucket reaches the second extreme position (FIG. 3). In the extreme positions, the second fastening point 14 is preferably in or slightly under the plane V. The bucket 2 is thus locked in the extreme position. After all, upon further rotation, the freedom of movement of the operating arm 9 is limited in such a manner, for instance by means of an end stop, that the rotation of the bucket is stopped. However, the handles 11 will press the pin 12 downwards permanently, whereby rotation of the bucket is prevented until the handles are actively moved upwards. This has as an advantageous, safety and comfort-enhancing effect that if the bucket is forced in the direction of the central position by someone or something, the handles are pressed further downwards, against the end stop, so that the movement is prevented. The chair can be released for movement again through the lifting of the handles only.

In the exemplary embodiment shown, the angle a included between the first position (FIG. 2) and the second position (FIG. 3) of the chair is about 70°, but can be adjusted by means of the connecting rod 8. If the two end parts 17 are set further apart along the coupling rod 18, the angle included is increased, if the end parts 17 are positioned closer together, this angle is decreased. After all, if the length of the pin 12 and the connecting rod together corresponded to the perpendicular distance between the second axis of rotation and the first fastening point 13, the bucket 21 would no longer be able to rotate, while at a slightly greater length, a small angle of rotation a would already be possible.

Figure 5:
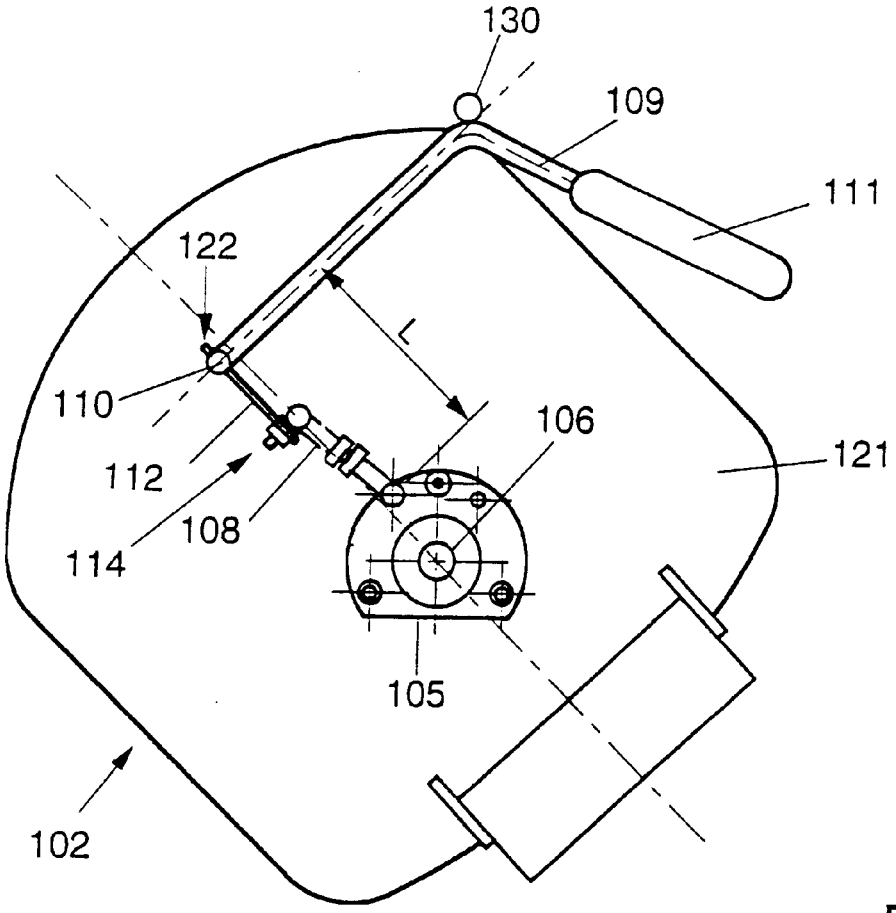
FIG. 5 is a bottom view of a swivel chair in an alternative embodiment.

FIG. 5 shows an alternative embodiment of a swivel chair according to the invention, wherein a first 106 and a second axis of rotation 110 extend approximately parallel to each other. In this embodiment, a swivel arm 109 is arranged in a swivel point 122 located under the bucket 121 for swivelling about the second axis of rotation 110, while the bucket 121 is again rotatable about the first axis of rotation 106. At the end located under the seat 102, the swivel arm 109 comprises a transverse pin 112 extending approximately at right angles to the longitudinal direction thereof, while the opposite end of the swivel arm 109 projects under the seat 102 and comprises a handle 111 that can be gripped besides the bucket. Attached to the free end 114 of the transverse pin 112 is a first end of the connecting rod 108, while the opposite end of the connecting rod 108 is connected to a fastening point on the fixedly disposed support part 105.

Figure 2:
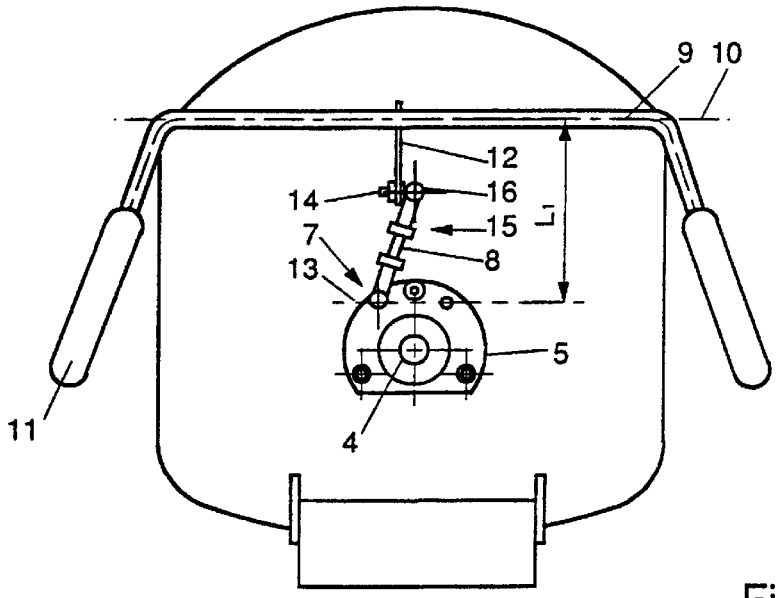
FIG. 2 is a bottom view of a swivel chair in FIG. 1, in a first position.

In two extreme positions, comparable with the positions shown in FIGS. 2 and 3, the transverse pin 112 and the connecting rod 108 extend approximately in line or at least parallel to each other. The perpendicular distance L between the first 106 and the second axis of rotation 110 is now maximal. In these two positions, the swivel arm 109 abuts against a stop 130 which prevents the swivel arm 109 from swivelling at least in one direction. When, from this position, the swivel arm is moved away from the stop 130, the perpendicular distance L between the first 106 and the second axis of rotation 110 shortens, causing the bucket 121 to move in the manner described hereinabove. For this embodiment, too, it applies that as a consequence of the mass inertia, the bucket will move on until it reaches the opposite extreme position, wherein the swivel arm is forced back into the starting position again. In this alternative embodiment, no "dead center" position is involved, but there have to be made provisions for blocking the bucket in the extreme positions.

The invention is by no means limited to the embodiments presented in the drawings and the specification. Many variations thereto are possible. For instance, in a construction of the swivel chair comparable with the embodiment given in FIGS. 1–4, the transverse pin 12 for setting the bucket in motion may have to be moved downwards rather than upwards, and the swivel arm may be of a different design, for instance with only one handle or with handles that are shaped or positioned differently. Up-and-down or back-and-forth movement of the end of the coupling bar remote from the first axis of rotation, whereby the movement of the bucket is in fact started, can be caused in a different manner, for instance by a swivel arm tiltable in an approximately vertical or inclined plane, by an assembly of a piston and a cylinder or, possibly, by a motor-driven energizer. The energy required therefor is minimal, so that the drawbacks of the known swivel chairs, wherein the rotation of the bucket itself is provided by a motor, are avoided, while such a swivel chair can also be used by users with minimal power. Moreover, the first and the second axis of rotation can in principle include any angle relative to each other. The bucket can be of a different design, for instance having a loose seat and/or back rest, and can be provided with, for instance, arm rests and a head rest, while the foot rest can be of a removable or foldable design, or can be left out. These and many comparable variations are understood to fall within the framework of the invention.

What is claimed is:

1. A swivel chair, comprising a seating part (2, 102) or a like support means and a support part (5, 105), wherein the seating part (2, 102) is pivotally connected, via a first axis of rotation (6, 106) which, during use, extends substantially vertically, to the support part (5, 105), whereby mechanical activating means (8, 9, 12; 108, 109, 112) are provided for swivelling the seating part (2, 102) around the first axis of rotation (6, 106), said activating means, during use, contacting at least temporarily the seating part (2, 102) on the one hand and the support part (5, 105) on the other, the arrangement being such that through operation of the activating means (8, 9, 12; 108, 109, 112), an activating force is exerted relative to the support part (5, 105) for initiation of a swivel movement of the seating part (2, 102), characterized in that the activating means (8, 9, 12; 108, 109, 112) are operable in at least two extreme positions of the seating part (2, 102) relative to the support part (5, 105), for initiating a swivel movement of the seating part (2, 102), wherein during movement of the seating part (2, 102) relative to the support part (5, 105) the activating means pass a dead-centre position to one of the extreme positions, said passing at least substantially caused under the influence of the mass inertia of the seating part (2, 102) and a user who may be present thereon.

2. A swivel chair according to claim 1, characterized in that the activating means comprise at least a swivel arm (9, 109) and a connecting rod (8, 108), wherein the swivel arm is rotatable about a second axis of rotation (10, 110) and is connected to the seating part (2, 102) so that when the seating part (2, 102) is swivelled, said swivel arm (9, 109) swivels together therewith around the first axis of rotation (6, 106), wherein the connecting rod (8, 108) is connected, adjacent a first (7) end thereof, to the support part (5, 105) and adjacent an opposite second end (15) thereof to the swivel arm (9, 109), at a distance from the second axis of rotation (10, 110), wherein, through swivel movement of the swivel arm (9, 109), the second end (15) of the connecting rod (8) is movable relative to the first (7) end, so that the perpendicular distance between the second axis of rotation (10, 110) and the first end (7) changes thereby.

3. A swivel chair according to claim 2, characterized in that the fastening point for the first end (7) of the connecting rod (8, 108) is located at a distance from the first axis of rotation (6, 106).

4. A swivel chair according to claim 2, characterized in that by the second axis of rotation (10, 110) and the first end (7) of the connecting rod (8, 108), a central plane (V) is defined, wherein the connecting rod (8, 108) can, through swivel movement of the swivel arm (9, 109), be brought into a first position wherein the first (7) and the second end (15) thereof are located in the central plane (V) and the distance between the first end and the second axis of rotation is almost maximal, and into a second position wherein the second end (15) of the connecting rod (8) has moved out of the central plane (V) and the distance between the first end (7) and the second axis of rotation (10, 110) is smaller.

5. A swivel chair according to claim 2, characterized in that the second axis of rotation (10), during use, extends almost horizontally.

6. A swivel chair according to claim 2, characterized in that at least one of the ends (7, 15) of the connecting rod (8, 108) is attached by means of a cardan shaft or universal joint (16).

7. A swivel chair according to claim 2, characterized in that the connecting rod (8, 108) comprises means for setting the length thereof.

8. A swivel chair according to claim 1, characterized in that the activating means comprise at least a swivel arm, which is rotatable about a second axis of rotation and comprises an eccentric cam part, wherein a run-on path is provided on the support part, said run-on path extending along at least a part of a circular path around the first axis of rotation, wherein the cam part in at least two positions of the seating part abuts, in a recess, against the run-on path, so that through rotation of the cam part, the cam part is moved against and subsequently along the run-on path while the seating part is being swivelled.

9. A swivel chair according to claim 1, characterized in that the activating means (9) comprise, on either side of the seating part (2), gripping means (11) for operation thereof.

10. A swivel chair according to claim 1, characterized in that the seating part (2, 102) comprises a foot rest (20) which is connected thereto and can swivel along with the seating part.

11. A swivel chair according to claim 1, characterized in that first locking means are provided on the seating part and second locking means are provided on the support part for locking the seating part in the two extreme positions against swivelling about the first axis of rotation.

12. A stair lift with a swivel chair comprising a seating part (2, 102) or a like support means and a support part (5, 105), wherein the seating part (2, 102) is pivotally connected, via a first axis of rotation (6, 106) which, during use, extends substantially vertically, to the support part (5, 105), whereby mechanical activating means (8, 9, 12; 108, 109, 112) are provided for swivelling the seating part (2, 102) around the first axis of rotation (6, 106), said activating means, during use, contacting at least temporarily the seating part (2, 102) on the one hand and the support part (5, 105) on the other, the arrangement being such that through operation of the activating means (8, 9, 12; 108, 109, 112), an activating force is exerted relative to the support part (5, 105) for initiation of a swivel movement of the seating part (2, 102), characterized in that the activating means (8, 9, 12; 108, 109, 112) are operable in at least two extreme positions of the seating part (2, 102) relative to the support part (5, 105), for initiating a swivel movement of the seating part (2, 102), wherein during movement of the seating part (2, 102) relative to the support part (5, 105) the activating means pass a dead-center position to one of the extreme positions, said passing at least substantially caused under the influence of the mass inertia of the seating part (2, 102) and a user who may be present thereon.

* * * * *

UNITED STATES PATENT AND TRADEMARK OFFICE

CERTIFICATE OF CORRECTION

PATENT NO. : 5,992,935
DATED : November 30, 1999
INVENTOR(S) : Duijnstee

It is certified that error appears in the above-identified patent and that said Letters Patent is hereby corrected as shown below:

Column 7,
Line 5, "a" should read -- α --
Line 16, "a" should read -- α --

Signed and Sealed this

Twelfth Day of February, 2002

*Attest:*

*Attesting Officer*

JAMES E. ROGAN
*Director of the United States Patent and Trademark Office*